US006460977B2

(12) United States Patent
Cho et al.

(10) Patent No.: US 6,460,977 B2
(45) Date of Patent: Oct. 8, 2002

(54) INK JET RECORDING HEAD UNIT AND IMAGE RECORDING DEVICE HAVING THE SAME

(75) Inventors: Syunka Cho; Norihiko Kurashima; Takahiro Katakura, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/866,560

(22) Filed: May 29, 2001

(65) Prior Publication Data

US 2002/0033866 A1 Mar. 21, 2002

(30) Foreign Application Priority Data

May 29, 2000 (JP) ..... 2000-157884
May 11, 2001 (JP) ..... 2001-140832

(51) Int. Cl.[7] ..... B41J 2/14
(52) U.S. Cl. ..... 347/65; 347/54; 347/66
(58) Field of Search ..... 347/87, 85, 86, 347/9, 20, 65, 66, 47, 48, 68, 69, 54

(56) References Cited

FOREIGN PATENT DOCUMENTS

| | | | | |
|---|---|---|---|---|
| EP | 0 726 151 A2 | | 8/1996 | ..... B41J/2/14 |
| EP | 0 820 871 A2 | | 1/1998 | ..... B41J/2/14 |
| EP | 1 057 633 A1 | | 12/2000 | ..... B41J/2/045 |
| JP | 01 138801 | | 5/1989 | ..... H01P/1/161 |
| JP | 0137644 | * | 5/1997 | ..... B41J/2/175 |

OTHER PUBLICATIONS

Patent Abstract of Japan vol. 1998, No. 04, Mar. 31, 1998 & JP 09 314832 a (Ricoh Co Ltd), Dec. 9, 1997.

* cited by examiner

*Primary Examiner*—Anh T. N. Vo
(74) *Attorney, Agent, or Firm*—Sughrue Mion, PLLC

(57) ABSTRACT

An ink jet recording head unit includes: at least one nozzle array in which a plurality of nozzle openings are arrayed; a plurality of common ink chambers, each adapted to store ink to be ejected; compliance parts provided to wall surfaces defining the common ink chambers, respectively; and a plurality of ink flow passages which supply ink from ink supplying sources through the common ink chambers to the nozzle openings. Of the plurality of the ink flow passages, an ink flow passage shorter than another ink flow passage has the compliance part of the common ink chamber, which is located at a middle of the ink flow passage and which is set smaller in comparison to the other ink flow passage.

8 Claims, 7 Drawing Sheets

INK JET RECORDING HEAD UNIT AND IMAGE RECORDING DEVICE HAVING THE SAME

BACKGROUND OF THE INVENTION

The present invention relates to an ink jet recording head unit provided with a plurality of ink flow passages, each being designed to supply ink to nozzle openings through a common ink chamber from an ink supply source, and also relates to an image recording device having the same.

An image recording device such as a printer, a plotter and a facsimile machine is available, which has an ink jet recording head provided with a plurality of ink flow passages each being designed to supply ink to nozzle openings through a common ink chamber from an ink cartridge.

A strong demand exists to miniature the ink jet recording head of this type, and thus the plurality of ink flow passages must be installed in a limited space. For this reason, it is difficult to make uniform the volumes of the common ink chambers.

Of the recording head capable of ejecting ink of plural colors, such a type is available, in which the number of nozzle openings of a black nozzle array frequently used for document print is more than the number of nozzle openings of another chromatic color nozzle array, and the recording head of this type is, in particular, difficult to make the volumes of the common ink chambers uniform.

The volume difference of the common chambers causes variation in flow passage resistance and inertance ink flow passage by ink flow passage, and consequently, ink ejection performance is varied.

Further, an ink cartridge is required to be larger to realize more and more print, and therefore it becomes more difficult to make uniform the length of an ink supply passage (for example, a flow passage from the ink cartridge to the recording head), which constitutes a part of the ink flow passage, causing large variation in ejection performance.

SUMMARY OF THE INVENTION

The present invention was made in view of the above circumstances, and an object thereof is to provide a recording head unit and an image recording device, which can prevent problems caused due to a reservoir-to-reservoir volume difference and a flow passage resistance difference.

The present invention is proposed in order to attain the above-noted object, and the invention provides, for instance, the followings:

(1) An ink jet recording head unit comprising: at least one nozzle array in which a plurality of nozzle openings are arrayed; a plurality of common ink chambers, each adapted to store ink to be ejected; compliance parts provided to wall surfaces defining the common ink chambers, respectively; and a plurality of ink flow passages which supply ink from ink supplying sources through the common ink chambers to the nozzle openings, wherein:

of the plurality of the ink flow passages, an ink flow passage longer than another ink flow passage has the compliance part of the common ink chamber, which is located at a middle of the ink flow passage and which is set smaller in comparison to the other ink flow passage.

(2) An ink jet recording head unit comprising: at least one nozzle array in which a plurality of nozzle openings are arrayed; a plurality of common ink chambers, each adapted to store ink to be ejected; compliance parts provided to wall surfaces defining the common ink chambers, respectively; and a plurality of ink flow passages which supply ink from ink supplying sources through the common ink chambers to the nozzle openings, wherein:

of the plurality of the ink flow passages, an ink flow passage smaller in flow passage resistance than another ink flow passage has the compliance part of the common ink chamber, which is located at a middle of the ink flow passage and which is set smaller in comparison to the other ink flow passage.

(3) An ink jet recording head unit comprising: at least one nozzle array in which a plurality of nozzle openings are arrayed; a plurality of common ink chambers, each adapted to store ink to be ejected; compliance parts provided to wall surfaces defining the common ink chambers, respectively; and a plurality of ink flow passages which supply ink from ink supplying sources through the common ink chambers to the nozzle openings, wherein:

of the plurality of the ink flow passages, an ink flow passage smaller in inertance than another ink flow passage has the compliance part of the common ink chamber, which is located at a middle of the ink flow passage and which is set smaller in comparison to the other ink flow passage.

(4) The ink jet recording head unit according to any of (1) to (3), wherein the nozzle array is divided into a plurality of nozzle blocks, and each of the nozzle blocks is communicated with a respective one of the common ink chambers, so that ink can be supplied block by block.

(5) The ink jet recording head unit according to (4), wherein the nozzle array is divided into three of the nozzle blocks, three of the common ink chambers are formed for the nozzle array, and ink of three kinds can be ejected from the single nozzle array.

(6) An image recording device including the inkjet recording head unit defined in any of (1) to (5).

The present disclosure relates to the subject matter contained in Japanese patent application Nos. 2000-157884 (filed on May 29, 2000), and 2001-140832 (filed on May 11, 2001), which are expressly incorporated herein by reference in their entireties.

DESCRIPTION OF THE PREFERRED EMBODIMENT

The preferred embodiment of the present invention will be described with reference to the accompanying drawings.

Figure 1:
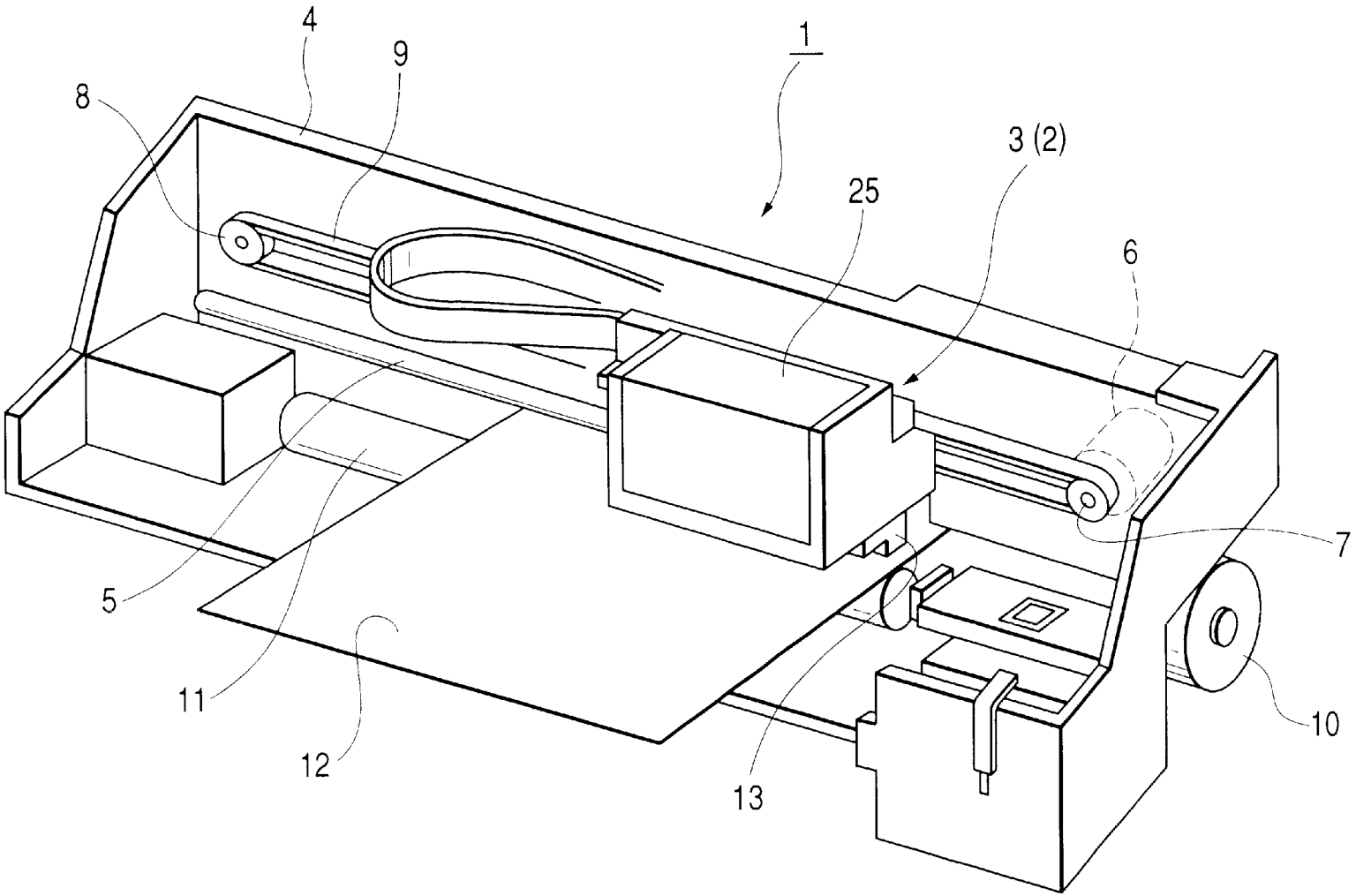
FIG. 1 is a perspective view showing a structure of an ink jet printer.

FIG. 1 is a perspective view showing an ink jet printer 1 (referred to simply as a printer 1) which is a typical image recording device.

The printer 1 is provided with a carriage 3 having a recording head unit 2 (referred to simply as a head unit 2). The carriage 3 is reciprocatively moved in a main scan direction by means of a head scanning mechanism.

The head scanning mechanism is made up of a guide member 5 extending across a housing 4, a drive pulley 7 which is driven to rotate by a pulse motor 6 coupled thereto, a floating pulley 8, a timing belt 9 which is wound on and between the drive pulley 7 and the floating pulley 8, and coupled to the carriage 3, and a control unit (not shown) for controlling a rotation of the pulse motor 6. The printer 1 is provided with a paper feeding mechanism for feeding a recording sheet 12 in a paper feeding direction (sub-scan direction). The paper feeding mechanism includes a paper feeding motor 10, a paper feeding roller 11, and others, and successively feeds the recording sheet 12 in synchronism with a recording operation.

Figure 2:
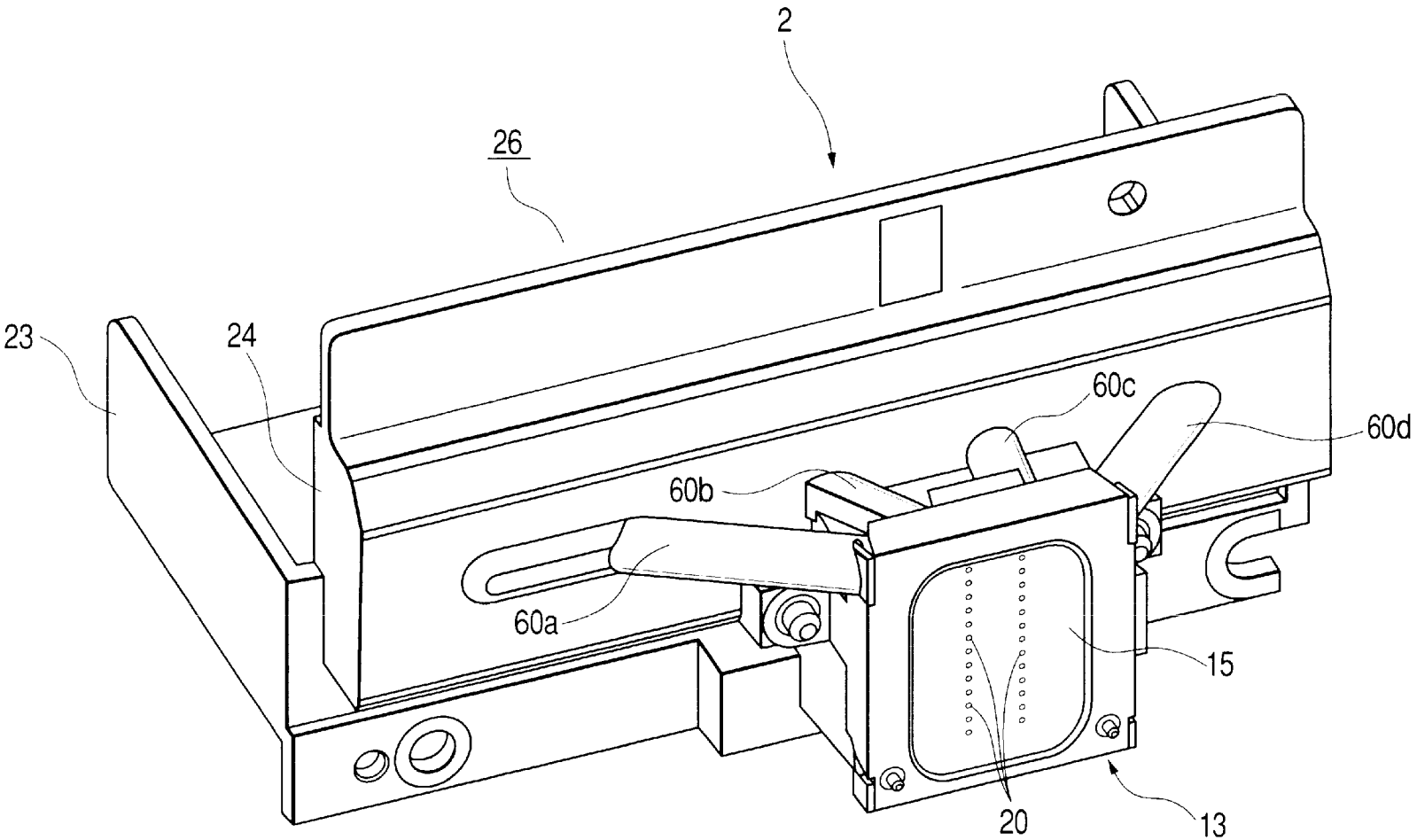
FIG. 2 is a perspective view showing a recording head unit as viewed from a recording head side.

Next, the head unit 2 will be described. As shown in FIG. 2, the illustrated headunit 2 includes a frame 23 made of synthetic resin. A cartridge holder 26 is formed on the upper surface of a base plate 24 of the frame 23. An ink cartridge 25 may be mounted on the cartridge holder 26.

Figure 3:
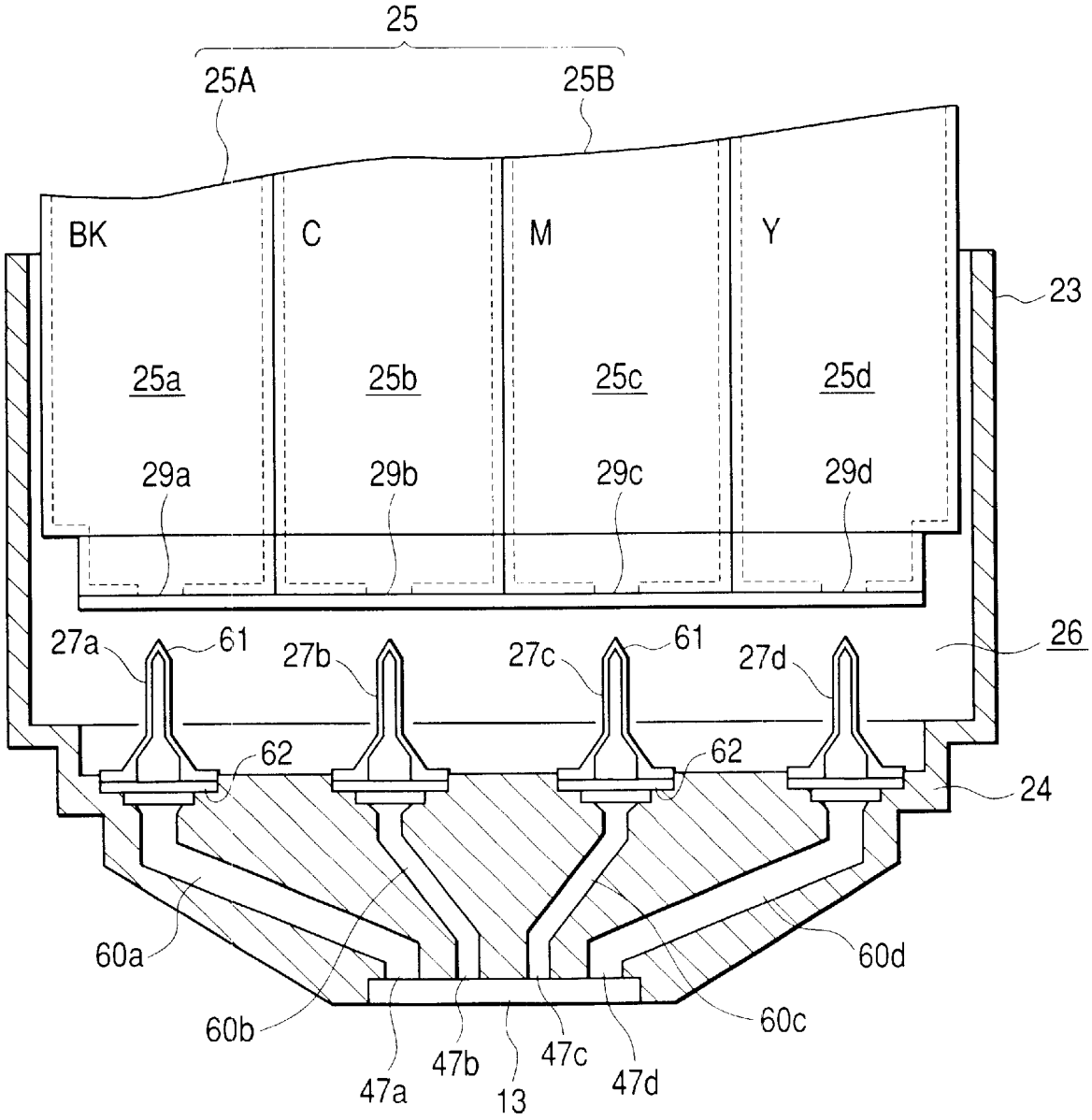
FIG. 3 is a cross sectional view showing a structure when an ink cartridge and the recording head unit are cut in the lateral direction.

The ink cartridge 25 is a hollowed box-like member whose inner space is partitioned into a plurality of ink chambers. Each ink chamber stores ink in a state that ink is retained in an ink absorbing member (not shown). As shown in FIG. 3, the ink cartridge 25 of the embodiment consists of a black cartridge 25A and a color cartridge 25B. The black cartridge 25A includes a single ink chamber 25*a* for storing blackink. The color cartridge 25B includes three ink chambers 25*b*, 25*c* and 25*d* respectively storing cyan ink, magenta ink and yellow ink. Needle coupling parts 29 ( 29*a* to 29*d*) are provided on the bottoms of the ink chambers 25*a* to 25*d*. Ink supplying needles 27 will be inserted into those needle coupling parts 29, respectively. The needle coupling parts 29 function as ink discharging ports of the ink reservoirs (corresponding to ink supplying sources in the description for defining the invention).

A recording head 13 is mounted, from below, on the lower surface of the base plate 24, which is located on the opposite side of the cartridge holder 26. The recording head 13 is communicated with the ink chambers 25*a* to 25*d* via corresponding ink supplying passages (ink supplying needles 27 and converging flow passages 60 to be described later). Ink of four colors stored in the ink cartridge 25 is supplied to the recording head 13 through those ink supplying passages, respectively.

Figure 4:
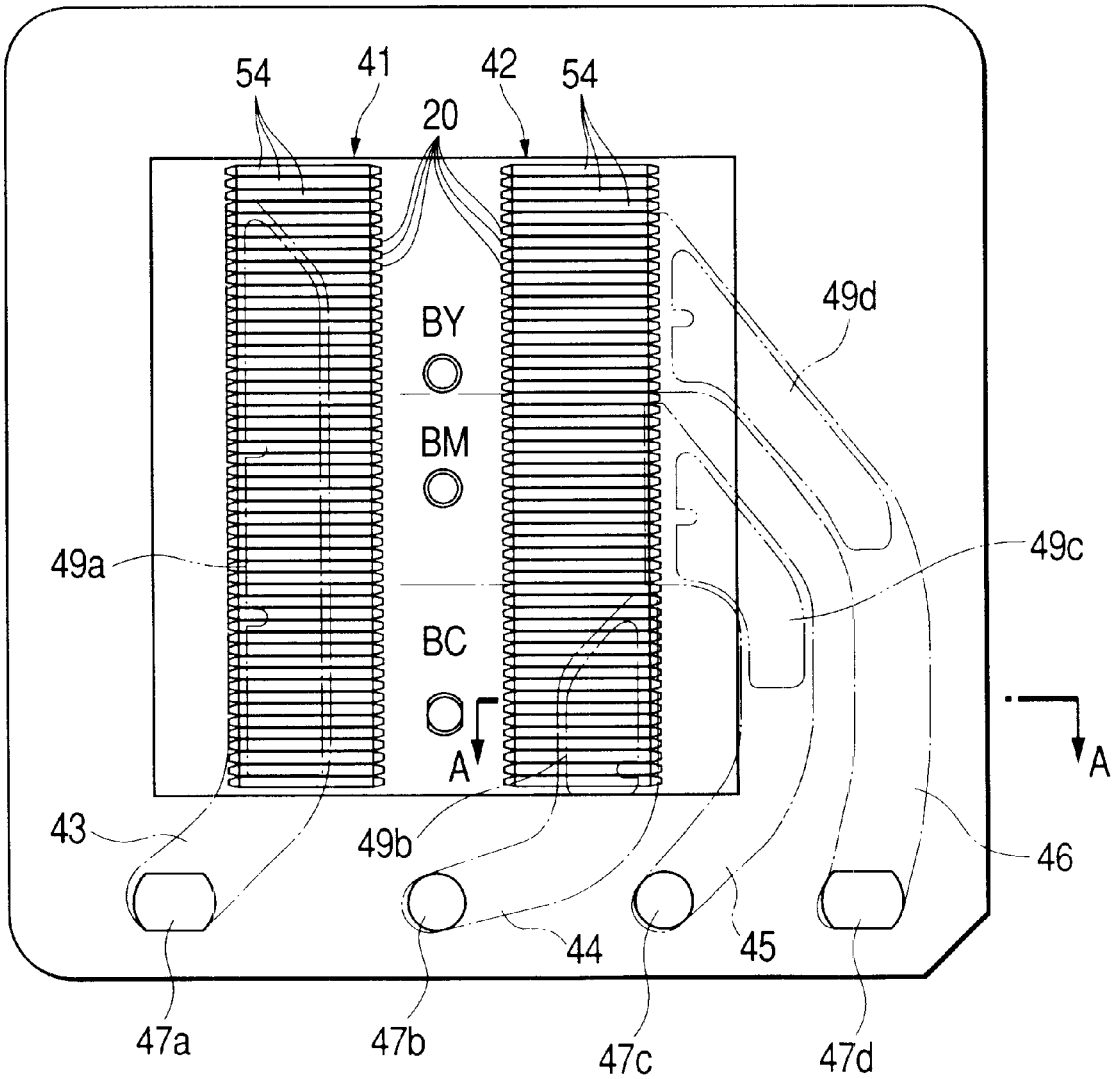
FIG. 4 is a plan view showing a recording head.
Figure 5:
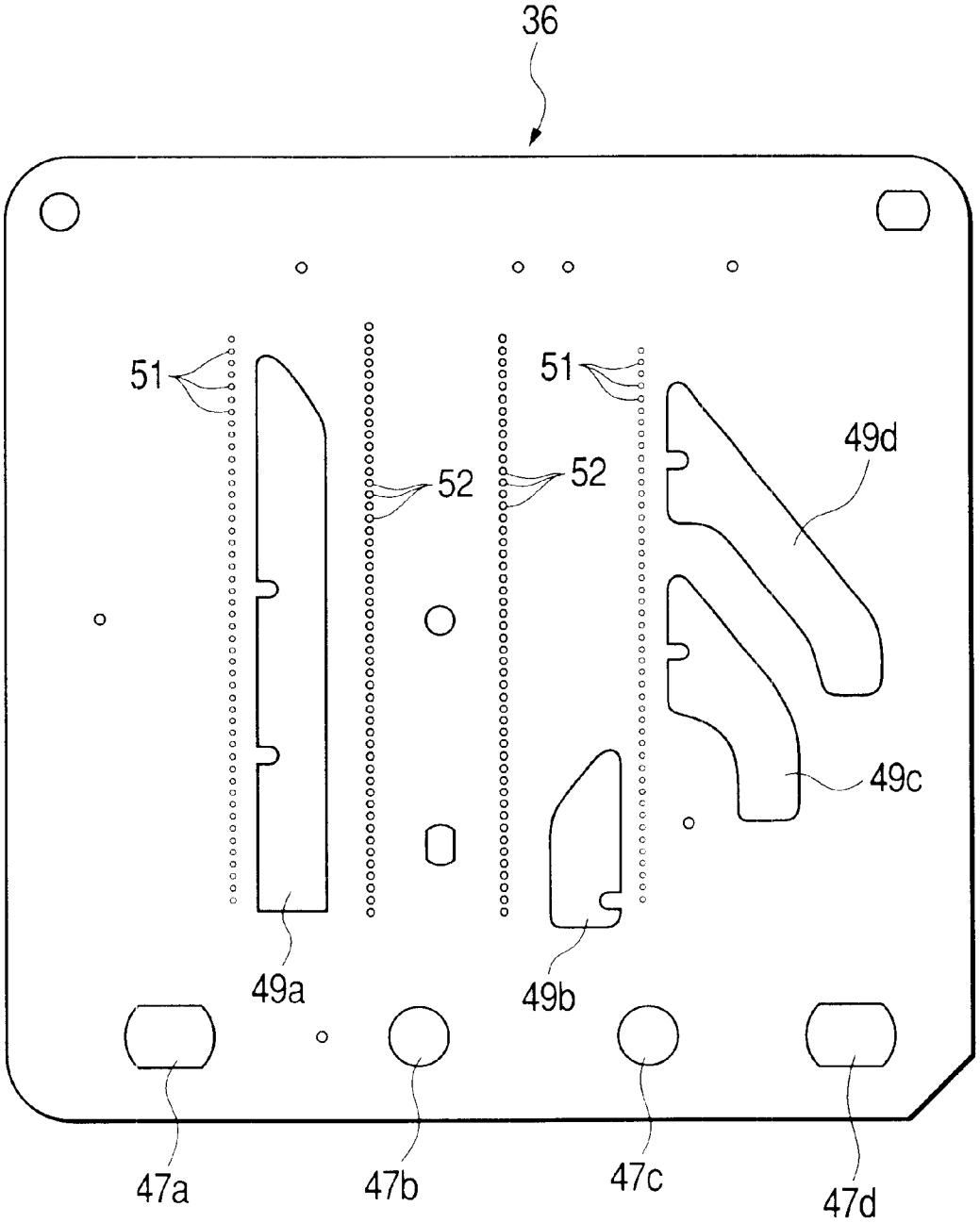
FIG. 5 is a plan view showing a supply port plate.
Figure 6:
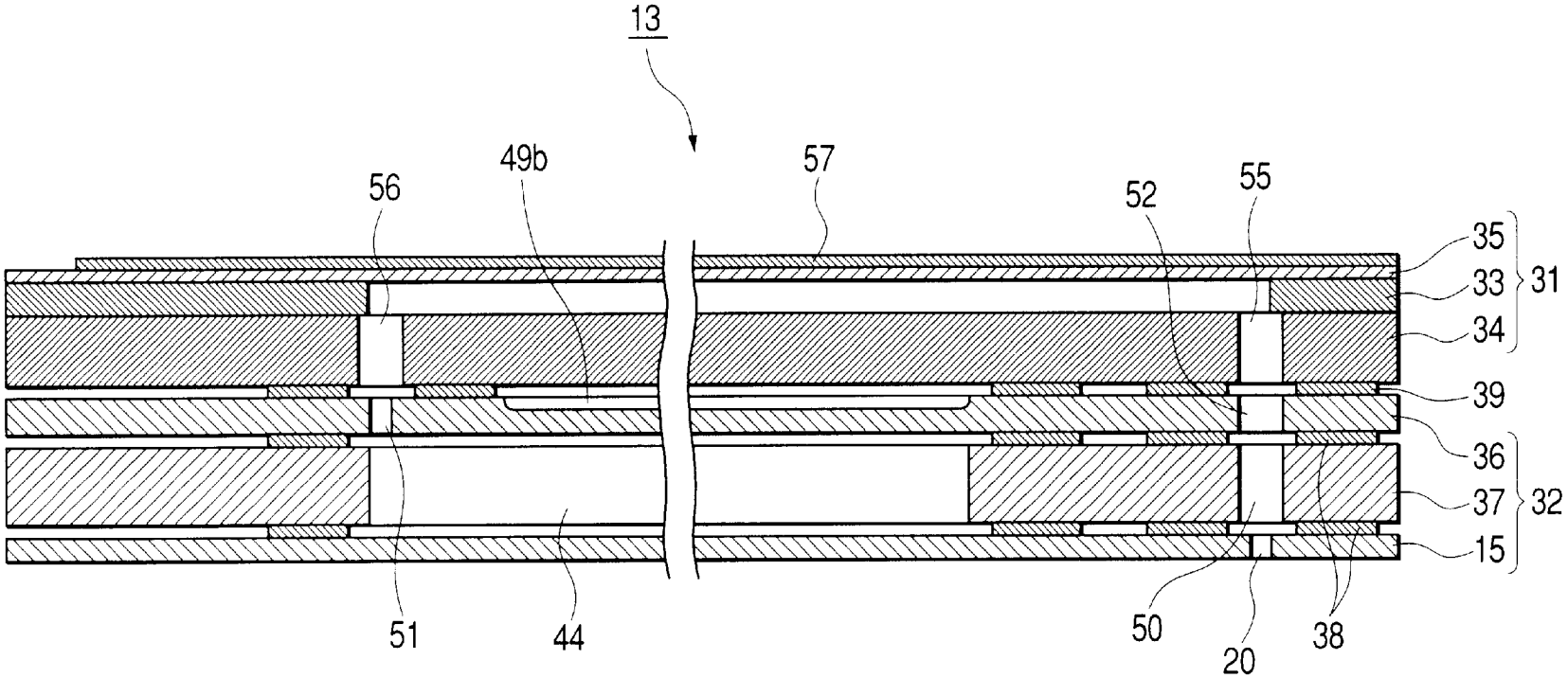
FIG. 6 is a cross sectional view taken on line A—A in FIG. 4.

As shown in FIGS. 4 through 6, the recording head 13 is generally composed of an actuator unit 31 and a flow passage unit 32. Specifically, the actuator unit 31 is superposed on the flow passage unit 32 into an integral form. The actuator unit 31 is constructed such that a pressure chamber plate 33, a pressure chamber substrate 34, and a vibrating plate 35 are laminated one on another, and then sintered or the like to provide an integral unit. The flow passage unit 32 is composed of a supply port plate 36, a reservoir plate 37 and a nozzle plate 15, and bonding films 38 are interposed therebetween, whereby those plates are jointed into a single unit. The actuator unit 31 and the flow passage unit 32 are coupled together into a single unit by means of an bonding film 39 being interposed therebetween.

The nozzle plate 15 is a thin plate like member made of a metallic material, e.g., stainless. A plurality of nozzle openings 20 . . . are arrayed in the nozzle plate 15 to pass therethrough in the thickness direction. Those nozzle openings 20 . . . are formed into two linear arrays arranged side by side. One of the two linear arrays is a single nozzle array 41, while the other is a divided nozzle array 42. The single nozzle array 41 is capable of ejecting ink of the same kind, and consists of, for example, 48 number of nozzle openings 20. In the embodiment, the single nozzle array 41 ejects black ink. In the divided nozzle array 42, the nozzle openings 20 are divided into blocks as viewed in the nozzle array direction. The divided nozzle array 42 is constructed by three nozzle blocks. Of those nozzle blocks, one nozzle block consists of, for example, 15 number of nozzle openings 20. In the embodiment, in FIG. 4, the upper nozzle block is a yellow block BY; the medium nozzle block is a magenta block BM; and the lower nozzle block is a cyan block BC, which are capable of ejecting yellow ink, magenta ink and cyan ink, respectively.

The reservoir plate 37 is a thin plate like member made of a metallic material, e.g., stainless, similarly to the nozzle plate 15.

First to fourth reservoirs 43 to 46 are formed in the reservoir plate 37. The first reservoir 43 is provided corresponding to the single nozzle array 41. The second to fourth reservoirs 44 to 46 are provided corresponding to the divided nozzle array 42. Those reservoirs are involved in common ink chambers in the description of defining the invention. The reservoirs are formed by opened portions passing through the reservoir plate in its thickness direction. The first reservoir 43 serves as a black reservoir for storing black ink. The second reservoir 44 is a cyan reservoir for storing cyan ink, and corresponds to the cyan block BC. The third reservoir 45 is amagenta reservoir for storing magenta ink, and corresponds to the magenta block BM. The fourth reservoir 46 is a yellow reservoir for storing yellow ink, and corresponds to the yellow block BY. Those reservoirs are equal in width as well as in depth, and extended to one end of the reservoir plate 37 as viewed in the nozzle array direction. At this end, the reservoirs are communicated with ink introducing ports 47 ( 47*a* to 47*d;* to be described later). Accordingly, in the divided nozzle array 42 of the embodiment, the second reservoir 44 for the cyan ink is shortest in length; the fourth reservoir 46 for the yellow ink is longest; and the third reservoir 45 for the magenta ink is intermediate between them.

A plurality of first nozzle communicating port 50 are formed in the reservoir plate 37 at positions corresponding to the nozzle openings 20, while passing through the reservoir plate in the thickness direction.

The supply port plate 36 is also a thin plate like member made of a metallic material, e.g., stainless. A plurality of ink supply ports 51, which are communicated with the reservoirs 43 to 46, are formed in the supply port plate at pitches equal to those of the nozzle openings 20. A plurality of second nozzle communicating ports 52 are formed in the supply port plate 36 at positions corresponding to the first nozzle communicating ports 50, while passing through the plate in the thickness direction. Each of those ink supply ports 51 serves as a portion for applying flow passage resistance (fluidic resistance) to ink within a respective one of the individual ink flow passages (to be described later).

Ink introducing ports 47 ( 47*a* to 47*d* ) are formed at one of the ends of the supplyport plate 36 as viewed in the communicating port array direction. The ink introducing ports 47 are communicated with the outlets of the ink supplying passages, and function as ink inlets in the recording head 13. Four ink introducing ports 47 are formed corresponding to the kinds of ink that can be ejected. Specifically, those ink introducing ports are a black ink introducing port 47*a,* a cyan ink introducing port 47*b,* a magenta ink introducing port 47*c,* and a yellow ink introducing port 47*d* in left-to-right order in FIG. 5.

Compliance parts 49 are formed in the supply port plate 36 at parts of the upper walls defining the reservoirs 43 to 46, viz., parts thereof overlapping with the openings for the reservoirs of the reservoir plate 37. The compliance parts 49 are each formed to be elastically deformable such that those parts of the supply port plate 36 are recessed to enhance flexibility while leaving elasticity. Each of those parts is deformed to vary the volume of the corresponding reservoir, thereby reducing a pressure variation. Specifically, when ink is supplied to the pressure chamber 54, the associated compliance part is deformed in such a direction as to reduce the volume of the associated reservoir, to thereby quicken and smooth the supplying of ink. When an ink droplet is ejected and a pressure is transmitted from the pressure chamber 54 to the compliance part, the compliance part is deformed in such a direction as to increase the volume of the reservoir.

The sizes of the compliance parts 49 are set as follows. In the divided nozzle array 42, the compliance part 49*b* for the second reservoir 44 having the shortest length is set to be smallest in area. The compliance part 49*d* for the fourth reservoir 46 having the longest length is set to be largest in area. The compliance part 49*c* for the third reservoir 45 having the medium length is set to have an area, which is intermediate in value between the areas of the above compliance parts. Thus, the sizes of the compliance parts are set in accordance with the lengths of the reservoirs each serving as a part of the respective ink flow passage. The reason why the compliance parts 49 have different sizes will be described later.

The pressure chamber plate 33 is a thin plate which is made of ceramics and has a thickness suitable for forming the pressure chambers 54. Specifically, it is a thin plate of alumina, zirconia, or the like. A plurality of opened portions serving as the pressure chambers 54 are formed passing through the plate in the thickness direction. The pressure chambers 54 are arrayed at pitches equal to those at which the nozzle openings 20 are arrayed. Each of the pressure chambers 54 is an elongated hole extending at a right angle to the array direction. In the embodiment, two right and left arrays of the pressure chambers 54 are disposed side by side. One (located on the right side in the figure) of the pressure chamber arrays serves as the pressure chambers 54 for the divided nozzle array 42, while the other (located on the left side in the figure) serves as the pressure chambers 54 for the single nozzle array 41.

The pressure chamber substrate 34 is a thin plate which is made of ceramics, as in the case of the pressure chamber plate 33, and which is formed with third communicating ports 55 and supply side communicating ports 56. The third communicating ports 55 are holes passing through the pressure chamber substrate in the plate thickness direction, while being positioned corresponding to the second nozzle communicating ports 52. Those ports 55 are respectively communicated with the ends of the pressure chambers 54, which are located closer to the nozzle openings. The supply side communicating ports 56 are holes passing through the pressure chamber substrate in the plate thickness direction, while being positioned corresponding to the ink supply ports 51. Those ports 56 are communicated with the ends of the pressure chambers 54 which are located in the opposite side from the third communicating ports 55.

The vibrating plate 35 is a thin, elastic plate made of ceramics. A plurality of piezoelectric vibrator elements 57 are disposed on the outer surface of the vibrating plate 35, which is opposite from the pressure chambers 54, to correspond in position to the pressure chambers 54, respectively. The illustrated piezoelectric vibration elements 57 are those of the bending vibration mode. Each of those vibration elements is driven in response to a drive signal supplied through a signal supplying cable (not shown) to vary the volume of the associated pressure chamber 54.

In the recording head 13 thus constructed, the ink introducing ports 47*a* to 47*d* are communicated with the reservoirs 43 to 46, respectively. The reservoirs 43 to 46 are communicated with the pressure chambers 54 via the ink supply ports 51 and the supply side communicating ports 56. Further, the pressure chambers 54 are communicated with the nozzle openings 20 via the nozzle communicating ports 50, 52 and 55. Accordingly, formed in the recording head 13 are head-side ink flow passages ranging from the ink introducing ports 47 to the nozzle openings 20 via the reservoirs 43 to 46 and the pressure chambers 54. Individual ink flow passages ranging from the ink supply ports 51 through the pressure chambers 54 to the nozzle openings 20 are formed between the reservoirs 43 to 46 and the nozzle openings 20.

Next, ink supplying passages, which communicates the needle coupling parts 29 of the ink chambers 25 to the ink introducing ports 47, will be described hereunder. As shown in FIG. 3, the ink supplying passages are constructed by ink supplying needles 27 (27*a* to 27*d*) to be inserted into the needle coupling parts 29, and converging flow passages 60 ( 60*a* to 60*d* ) whose inlets are communicated with the outlets of the ink supplying needles 27 and outlets are communicated with the ink introducing ports 47 (47*a* to 47*d*) of the recording head 13.

The ink supplying needle 27 is made of synthetic resin, and formed with a hollowed shaft portion having a flowing-in hole 61 at its tip, and a tapered part which extends downwardly from the hollowed shaft portion in a state that its side wall is tapered outwardly from the hollowed shaft portion. A flange is formed at the lower end of the tapered portion. A filter 62 is located under the flange.

The converging flow passage 60, as described above, is a flow passage for communication between the ink supplying needle 27 and the ink introducing port 47, which extends downwardly from the outlet of the ink supplying needle 27 and is substantially circular in section in the width direction.

In the present embodiment, the order by which the ink introducing ports 47*a* to 47*d* are disposed corresponds to the order by which the ink chambers 25*a* to 25*d* are disposed. That is, in FIG. 3, by the order from the left side, the ink chamber 25*a* and the ink introducing port 47*a* for black ink; the ink chamber 25*b* and the ink introducing port 47*b* for cyan ink; the ink chamber 25*c* and the ink introducing port 47*c* for magenta ink; and the ink chamber 25*d* and the ink introducing port 47*d* for yellow ink are disposed.

The lateral width of the ink cartridge 25 is sufficiently larger than that of the recording head 13. Accordingly, when the spatial interval at which the ink supplying needles 27 are disposed is compared with the pitch at which the ink introducing ports 47 are disposed, the former is wider than the latter. Accordingly, the converging flow passages 60*a* to 60*d* are extended while being slanted downward so as to be converged to the recording head 13 side.

The recording head 13 is disposed substantially right under the ink supplying needle 27*b* for cyan ink and the ink supplying needle 27*c* for magenta ink. A distance from the ink supplying needle 27*a* for black ink to the black ink introducing port 47*a* and a distance from the ink supplying needle 27*d* for yellow ink to the yellow ink introducing port 47*d* are longer than a distance from the ink supplying needle 27*b* for cyan ink to the cyan ink introducing port 47*b* and a distance from the ink supplying needle 27*c* for magenta ink to the magenta ink introducing port 47*c* .

Accordingly, the lengths of the converging fluid passages 60*a* to 60*d* are such that the converging flow passage 60*a* for black ink and the converging flow passage 60*d* for yellow ink are long, while the converging flow passage 60*b* for cyan ink and the converging flow passage 60*c* for magenta ink are short.

With provision of the ink supplying passages and the head-side ink flow passages, four ink flow passages corresponding to the kinds of ink are formed ranging from the flowing-in holes 61, serving as the inlets (ink supplying sources) of the ink supplying passages, to the nozzle openings 20. Of those four ink flow passages, the ink flow passages for the divided nozzle array 42 for color ink are compared on their lengths. Then, the converging flow passage 60*b* for cyan ink and the converging flow passage 60*c* for magenta ink are equal in length, but the lengths of the head-side ink flow passages, specifically, the lengths of the reservoirs are such that the second reservoir 44 for cyan ink is shorter than the third reservoir 45 for magenta ink. Accordingly, the cyan ink flow passage is shortest, the magenta ink flow passage is short next to the former, and the yellow ink flow passage is longest.

A flow passage resistance (fluidic resistance) of each ink flow passage varies depending on a length and a cross sectional area of the ink flow passage. Here, the length of the ink flow passage is a distance from the flowing-in hole 61 (ink supplying source), serving as the inlet of the ink supplying passage, to the nozzle opening 20. In the recording head 13 with the plurality of nozzle openings 20 as of the present embodiment, a distance measured from the flowing-in hole 61 to the center of the nozzle array as viewed in the array direction (viz., an average distance) is the length of the ink flow passage. For example, the length of the ink flow passage for black ink is a distance to a position between the $24^{th}$ nozzle opening 20 and the $25^{th}$ nozzle opening 20 as counted from the end of the nozzle array 41. The length of the ink flow passage for yellow ink is a distance to the $8^{th}$nozzle opening 20 as counted from the end of the array of the nozzle openings 20 forming the yellow block BY. Similarly, the length of each of the magenta and cyan ink flow passages is a distance to the $8^{th}$ nozzle opening 20 as counted from the end of the opening array block.

With regard to the head-side ink flow passages ranging from the ink introducing ports 47 to the terminal ends of the ink flow passages, the yellow ink flow passage is longest, the black ink flow passage and the magenta ink flow passage are next short, and the cyan ink flow passage is shortest. Accordingly, when the entire ink flow passages are compared, the yellow ink flow passage is longest, and the black ink flow passage is next long, and the cyan ink flow passage is shortest and the magenta ink flow passage is next short.

If the inner diameters of the ink supplying passages are set to be equal to one another all over the ink flow passages, a longer ink flow passage has a larger flow passage resistance in comparison to a shorter ink flow passage since the flow passage resistance is determined substantially depending on the length of the ink flow passage.

To cope with this, in the present embodiment, the cross sectional areas of the ink supplying passages are varied depending on the lengths of the ink supplying passages. That is, a longer ink supplying passage has a larger cross sectional area of the ink supplying passage. Specifically, in the embodiment, the converging flow passages 60*a* and 60*d* for black ink and yellow ink are 1.4 mm in diameter. The converging flow passages 60*b* and 60*c* for magenta ink and cyan ink are 1.2 mm in diameter. It is noted that those numerical values of the diameter are selected by way of example, and other values may be appropriately selected as a matter of course. In an example of such, those converging flow passages 60 maybe converging flow passages of three different diameters: the converging flow passage 60*d* for yellow ink is 1.4 mm in diameter; the converging flow passage 60*a* for black ink is 1.3 mm in diameter; and the converging flow passages 60*b* and 60*c* for magenta ink and cyan ink are 1.2 mm in diameter.

Thus, the ink supplying passages of different lengths can be made to have uniform flow passage resistance by varying the diameters of the converging flow passages 60*a* to 60*d* depending on the lengths of the ink supplying passages.

To record a clear image, it is necessary to make uniform the characteristics of the ink ejection from the nozzle openings. This is importance in particular in the color image recording. The ink ejection characteristic is greatly affected by the flow passage resistance, inertance and compliance of the ink flow passage. The flow passage resistance is an internal loss during the flow of ink, and thus increases as the length of the ink flow passage increases. The inertance is a mass of ink per unit length.

The flow passage resistance of the ink flow passage will be described. Even if the cross sectional areas of the converging flow passages 60 are adjusted, the cyanink flow passage is shortest, the magenta ink flow passage is next short, and the yellow ink flow passage is longest since the reservoirs forming parts of the ink flow passages are different in length (the second reservoir 44 for cyan ink is shortest, the third reservoir 45 for magenta ink is next short, and the fourth reservoir 46 for yellow ink is longest) . Accordingly, also for the resistance of the ink flow passages, the flow passage resistance of the cyan ink flow passage is smallest in value; the magenta ink flow passage is next small; and the yellow ink flow passage is largest.

The flow passage resistance acts, for example, as a resistance to impede a flow of ink absorbed into the pressure chamber 54 when the chamber is expanded. At this time, the compliance part 49 deforms and the volume of the reservoir decreases, whereby the impediment of the ink flow is supplemented. Therefore, for the ink flow passage having a large flow passage resistance, it is necessary that the compliance part 49 is large in size. For the ink flow passage having a small flow passage resistance, if the compliance part 49 used is small, no problem arises. For this reason, in the embodiment, the compliance part 49*b* of the second reservoir 44 whose flow passage resistance is smallest is smallest in size; the compliance part 49*c* of the third reservoir 45 whose flow passage resistance is next small is small next to the compliance part 49*b*; and the compliance part 49*d* of the fourth reservoir 46 whose flow passage resistance is largest is largest.

In the case of the divided nozzle array 42 consisting of a plurality of nozzle blocks, of the plural ink flow passages that are communicated from the nozzle blocks through the reservoirs to the ink supplying sources, an ink flow passage smaller in flow passage resistance than another ink flow passage may have a smaller compliance part 49*b* of the reservoir, provided in the middle of the ink flow passage, in comparison to the other ink flow passage, and this will not cause non-uniformity of the ink ejection characteristic.

In general, as the ink flow passage is longer, the flow passage resistance is larger. To the contrary, as it is shorter, the flow passage resistance is smaller. Accordingly, in the embodiment, no problem arises if the sizes of the compliance parts 49 are selected as mentioned above. That is, the compliance part 49*b* of the second reservoir 44, which forms a part of the cyan ink flow passage shortest in length, is smallest. The compliance part 49*c* of the third reservoir 45, which forms a part of the magenta ink flow passage next short, is next small. The compliance part 49*d* of the fourth reservoir 46, which forms a part of the yellow ink flow passage longest, is large.

In short, in the case of the divided nozzle array 42, of the plurality of ink flow passages communicated from the nozzle blocks through the reservoirs to the ink supplying sources, an ink flow passage shorter in length than another ink flow passage may have a smaller compliance part 49 of a reservoir, provided in the middle of the ink flow passage, in comparison with the other ink flow passage.

The inertance of the ink flow passage will be described. The cross sectional areas of the second, third and fourth reservoirs 44, 45 and 46 are almost equal to one another. Accordingly, the inertance values in those reservoirs 49 are also substantially equal. The cross sectional areas of the converging flow passages 60 are selected to be different from one another. Accordingly, the inertance value of the yellow ink flow passage is largest, and the inertance values of the cyan and magenta ink flow passages are small.

Where the inertance is large, large energy is required when the pressure chamber expands to absorb ink thereinto. Accordingly, the ink moves slowly and hence, the response performance is degraded. In this situation, the compliance part 49 deforms to supplement the response performance degradation with the reduction of the volume of the reservoir. Accordingly, for the ink flow passage of large inertance, it is necessary that the compliance part 49 is large. In the case of the ink flow passage of small inertance, if the compliance part 49 is small, no problem arises. Therefore, in the embodiment, as described above, no trouble occurs if the compliance part 49*b* of the second reservoir 44 forming a part of the cyan ink flow passage of small inertance is set to be smaller than the compliance part 49*d* of the fourth reservoir 44 which forms a part of the yellow ink flow passage of large inertance.

Thus, of the plural ink flow passages communicated from the nozzle blocks to the ink supplying sources via the reservoirs, an ink flow passage smaller in inertance than another ink flow passage may have a smaller compliance part 49 of a reservoir, provided in the middle of the ink flow passage, in comparison to the other ink flow passage.

Figure 7:
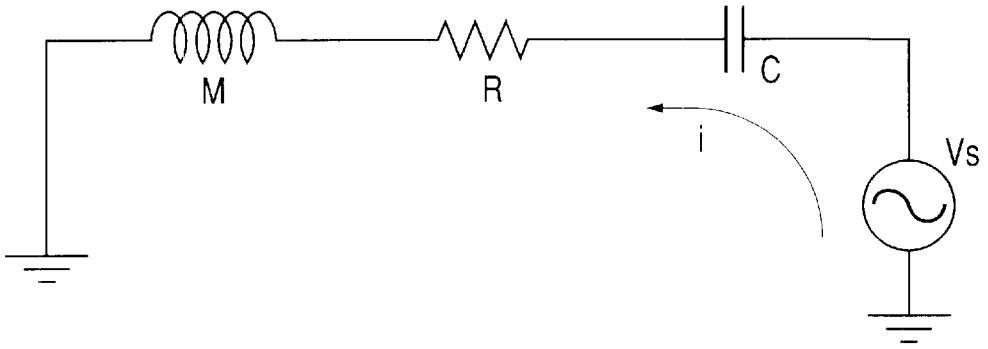
FIG. 7 shows a simple equivalent electric circuit of a reservoir section.

The fluid system mentioned above may also be described by using a simple equivalent electrical circuit on the reservoir portion, which is shown in FIG. 7. When apiezoelectric vibration vibrator is driven to pressurize an associated pressure chamber, a relation given by an equation (1) holds for a pressure Vs at the outlet of the pressure chamber because the fluid system operates as if current "i" flows in the FIG. 7 equivalent electrical circuit. In the equation, Vs is a pressure at the outler of the pressure chamber, C is compliance of the reservoir portion, R is resistance of an ink flow passage ranging from the outler of the pressure chamber to the reservoir portion, and M is inertance of the ink flow passage extending over the same range.

$$\text{Equation (1)} \quad i'MI - iR + \frac{\int_o^t i\,dt}{C} = Vs; \tag{1}$$

Where the pressure Vs at the outlet of the pressure chamber is large, the cross talk or the like is large, hindering normal ejection because, for example, an unnecessary pressure variation may given to other pressure chambers. Therefore, to make the ink ejection characteristic uniform, it is required that the pressure Vs is selected to be below a predetermined value of pressure.

Let us consider the relations of M, R and C to the current "i" under the condition that the equation (1) holds. From the equation, as M and/or R is smaller, Vs is lower. In other words, the equation (1) shows that if the ink flow passage up to that point, including the reservoir, is short, Vs is low. The equation (1) also teaches that as C is larger, viz., the area of the compliance part is larger, Vs is lower. Additionally, from the equation (1), it is seen that when M and/or R is small, Vs does not increase even if C is somewhat reduced.

Accordingly, in the case of the divided nozzle array 42, of the plural ink flow passages that are communicated from the nozzle blocks through the reservoirs to the ink supplying sources, an ink flow passages smaller in flow passage resistance than another ink flow passage may have a smaller compliance part 49 of a reservoir, provided in the middle of the ink flow passage, in comparison to the other ink flow passage, or an ink flow passage shorter in length than another ink flow passage may have a smaller compliance part 49 of a reservoir, provided in middle of the ink flow passage, in comparison to the other ink flow passage. Further, of the plural ink flow passages that are communicated from the nozzle blocks through the reservoirs to the ink supplying sources, an ink flow passage smaller in inertance than another ink flow passage may have a smaller compliance part 49 of a reservoir, provided in the middle of the ink flow passage, in comparison to the other ink flow passage.

In this way, the compliance parts 49 are optimized in size in a state that the ink ejection characteristic of the blocks is made uniform. Accordingly, the compliance part 49*b* of the ink flow passage which is difficult in forming a large compliance part 49 therein (viz., in the embodiment, the shortest second reservoir 44) can be set small in size. Consequently, the recording head 13 capable of recording a clear image may be reduced in size without any unreasonable modification.

In the embodiment, the compliance parts 49 are constructed by forming the thinned parts in the supply port plate 36. However, the compliance part in the present invention should not be restricted thereto. For example, the compliance part may be constructed such that a film is formed as a part of the wall forming the reservoir. In short, the compliance part may take any form if it has such a damper function that it is elastically deformed to lessen a pressure variation.

In the head unit 2 described above, the converging flow passages 60 are downward slanted from the ink supplying needles 27 to the ink introducing ports 47. The present invention should not be restricted to this example. If required, the converging flow passages may be formed in a planar member.

It should be understood that the present invention is not limited to the above-mentioned embodiment, but it may variously be modified, changed and altered within the scope of the present invention as defined in the appended claims.

For example, in the embodiment, the recording head 13 is exemplified, in which the nozzle array 42 is divided into the three nozzle blocks BY, BM and BC, and the three reservoirs (common ink chambers) 44, 45 and 46 for the respective nozzle array blocks are formed, so that three kinds of ink can be ejected from the single nozzle array, but the present invention should not be restricted to this construction.

Figure 8A:
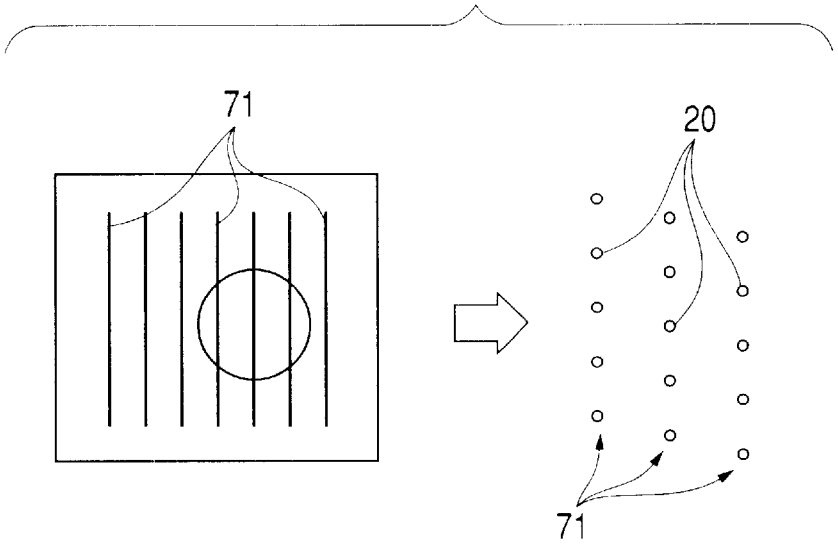
FIGS. 8(*a*) to 8(*c*) show modifications of nozzle arrays.
Figure 8B:
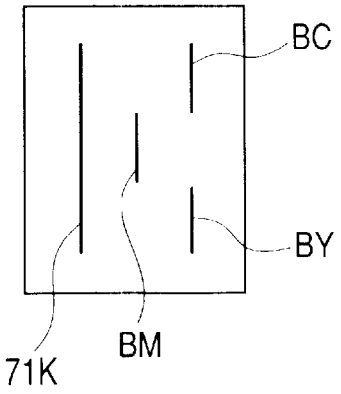
Figure 8C:
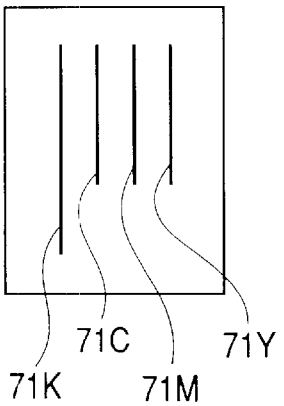

For example, the present invention can be applied to a recording head in which a plurality of nozzle arrays 71 . . . are arranged side by side, and nozzle openings 20 in the nozzle arrays are offset at a predetermined pitch array by array as shown in FIG. 8(*a*). Further, the present invention can be applied to a recording head in which the cyan block BC, the yellow block BY and the magenta block BM are disposed in an alternate (zigzag) fashion, and the black nozzle array 71 longer in length and having larger number of nozzle openings 20 is disposed at a lateral side of these blocks as shown in FIG. 8(*b*). Moreover, the present invention can be applied to a recording head in which the black nozzle array and the chromatic color nozzle arrays (the cyan nozzle array, the magenta nozzle array and the yellow nozzle array) differs in number of the nozzle openings 20.

That is, even in the recording heads having the above construction, the reservoirs differ in volume (length and width), ink flow passage by ink flow passage. But by optimizing sizes of the compliance parts, ink ejection characteristics can be made uniform.

As to the recording head, the present invention can be applied to a recording head which uses piezoelectric vibrators of the longitudinal vibration mode. Similarly, the present invention can be applied to a recording head of the type in which air bubbles are generated by heating heat generating elements to thereby eject ink droplets with the generated air bubbles. While in the above-mentioned embodiment, ink of different colors is ejected using the divided nozzle array, ink of different kinds, e.g., pigment ink and dye ink, may be ejected.

As seen from the foregoing description, the present invention has the following useful effects.

The size of the compliance part can be set in accordance with the length of the ink flow passage. With this feature, also in the short ink flow passage, a sufficient compliance is secured. Accordingly, the ink ejection characteristics at the nozzle openings can be made uniform, so that a clear picture can be recorded.

The ink flow passages may be made different in length. Therefore, also in the recording head unit in which a nozzle array is divided into a plurality of nozzle blocks, the ink flow passages can be formed in desired directions. This feature leads to reduction of the device size. Further, its manufacturing is easy, and its manufacturing cost is reduced.

For the ink flow passage of which the flow passage resistance and the inertance are small, use of a small compliance part suffices. This fact accrues to increase of design freedom, easy manufacturing and manufacturing cost reduction.

What is claimed is:

1. An ink jet recording head unit comprising:

at least one nozzle array in which a plurality of nozzle openings are arrayed;

a plurality of common ink chambers, each adapted to store ink to be ejected;

a plurality of compliance parts provided to wall surfaces defining the common ink chambers, respectively; and a plurality of ink flow passages which supply ink from ink supplying sources through the common ink chambers to the nozzle openings;

wherein, of the plurality of the ink flow passages, an ink flow passage shorter than another ink flow passage has one of the plurality of compliance parts of the common ink chamber, which is located at a middle of the ink flow passage wherein said one of the plurality of compliance parts is set smaller in comparison to another one of the plurality of compliance parts of the other ink flow passage.

2. An ink jet recording head unit comprising:

at least one nozzle array in which a plurality of nozzle openings are arrayed;

a plurality of common ink chambers, each adapted to store ink to be ejected;

a plurality of compliance parts provided to wall surfaces defining the common ink chambers, respectively; and a plurality of ink flow passages which supply ink from ink supplying sources through the common ink chambers to the nozzle openings, wherein, of the plurality of the ink flow passages, an ink flow passage smaller in flow passage resistance than another ink flow passage has the one of the plurality of compliance parts of the common ink chamber, wherein said one of the plurality of compliance parts is located at a middle of the ink flow passage and which is set smaller in comparison to another one of the plurality of compliance parts of the other ink flow passage.

3. An ink jet recording head unit comprising:

at least one nozzle array in which a plurality of nozzle openings are arrayed;

a plurality of common ink chambers, each adapted to store ink to be ejected;

a plurality of compliance parts provided to wall surfaces defining the common ink chambers, respectively; and a plurality of ink flow passages which supply ink from ink supplying sources through the common ink chambers to the nozzle openings, wherein, of the plurality of the ink flow passages, an ink flow passage smaller in inertance than another ink flow passage has the one of the plurality of compliance parts of the common ink chamber, wherein said one of the plurality of compliance parts is located at a middle of the ink flow passage and which is set smaller in comparison to another one of the plurality of compliance parts of the other ink flow chamber.

4. The ink jet recording head unit according to any of claims 1 to 3, wherein the nozzle array is divided into a plurality of nozzle blocks, and each of the nozzle blocks is communicated with a respective one of the common ink chambers, so that ink can be supplied block by block.

5. The ink jet recording head unit according to claim 4, wherein the nozzle array is divided into three of the nozzle blocks, three of the common ink chambers are formed for the nozzle array, and ink of three kinds can be ejected from the single nozzle array.

6. An image recording device including the inkjet recording head unit defined in claim 1.

7. The ink jet recording head unit according to claim 1, wherein:

the ink flow passages includes respective converging flow passages extending from the ink supplying sources to inlets of the common ink chambers, and of the converging flow passages, a longer converging flow passage has a larger cross-sectional area.

8. The ink jet recording head unit according to claim 1, wherein:

of the common ink chambers, a common ink chamber shorter than another common ink chamber has the one of the plurality of compliance parts smaller than another one of the plurality of compliance parts of the other common ink chamber.

* * * * *